United States Patent [19]

Miller et al.

[11] Patent Number: 4,912,893

[45] Date of Patent: Apr. 3, 1990

[54] TRANSPORTABLE CMR CELL SITE

[76] Inventors: Harmon R. Miller, 16631 Crommarty Ct., Houston, Tex. 77084; William J. Smith, 4403 Leeland, Houston, Tex. 77023; Hollie M. Stanley, Jr., 6635 Gulston, Ste. 210, Houston, Tex. 77081

[21] Appl. No.: 135,871

[22] Filed: Dec. 21, 1987

[51] Int. Cl.[4] ..... E04H 1/00

[52] U.S. Cl. ..... 52/79.1; 52/143; 52/79.4; 52/148

[58] Field of Search ..... 52/79.1, 79.4, 79.5, 52/111, 122.1, 143; 343/718, 780, 878

[56] References Cited

U.S. PATENT DOCUMENTS

| | | | |
|---|---|---|---|
| 1,426,276 | 8/1922 | Christie | 52/28 |
| 2,761,531 | 9/1956 | Anderson | 52/726 |
| 2,923,382 | 2/1960 | Heldstab | 52/148 |
| 2,973,818 | 3/1961 | Marvin | 280/411 A |
| 3,289,364 | 12/1966 | Watts, Jr. | 52/143 X |
| 3,582,131 | 3/1969 | Brown | 296/27 |
| 4,216,636 | 8/1980 | Cordell | 52/726 |
| 4,320,607 | 3/1982 | Eubank | 52/143 |
| 4,649,675 | 3/1987 | Moldovan et al. | 52/40 X |
| 4,748,655 | 5/1988 | Thrower et al. | 379/58 X |
| 4,750,197 | 6/1988 | Denekamp et al. | 379/58 |

FOREIGN PATENT DOCUMENTS

| | | | |
|---|---|---|---|
| 142567 | 7/1951 | Australia | 52/263 |
| 3729793 | 3/1988 | Fed. Rep. of Germany | 52/146 |
| 760187 | 12/1933 | France | 52/151 |

*Primary Examiner*—David A. Scherbel
*Assistant Examiner*—Creighton Smith
*Attorney, Agent, or Firm*—John A. Odozynski

[57] ABSTRACT

CMR (Cellular Mobile Radiotelephone) equipment is disposed in a configuration that facilitates both transportation to a cell site and, at the site, rapid installation of the CMR equipment and accompanying antenna tower. The CMR equipment incorporates a foundation that includes (i) a rectangular center structure formed from a front horizontal section, a rear horizontal section, a left vertical section, and a right vertical section, and (ii) a nose structure attached to and extending vertically from the front horizontal section. A self-contained CMR equipment edifice, having four walls, a floor and a roof, is secured to the rectangular center structure of the foundation by a plurality of flanges positioned at predetermined locations on the edifice and affixed to both the foundation and walls of the edifice. Several antenna tower sections are attached to the edifice by a number of identical antenna mounting assemblies. Each of the antenna mounting assemblies comprises a bracket attached to a wall of the edifice and a pipe strap removably affixed to the bracket. Left and right crossmember sections are attached to walls of the edifice by the above-mentioned flanges. The left and right crossmember sections are, in turn, respectively secured to top plates of the left vertical and right vertical sections, thereby securing the edifice to the foundation. Left and right leg sections, pivotably attached to opposite ends of the rear horizontal section, are folded into proximity with, respectively, the left vertical section and the right vertical section. In a preferred embodiment, the rear horizontal section includes a left bracket plate pair, disposed at the left end of the rear horizontal section, for accommodating the pivotable attachment of the left leg section. A right bracket plate pair is similarly disposed at a right end for the right leg section.

33 Claims, 9 Drawing Sheets

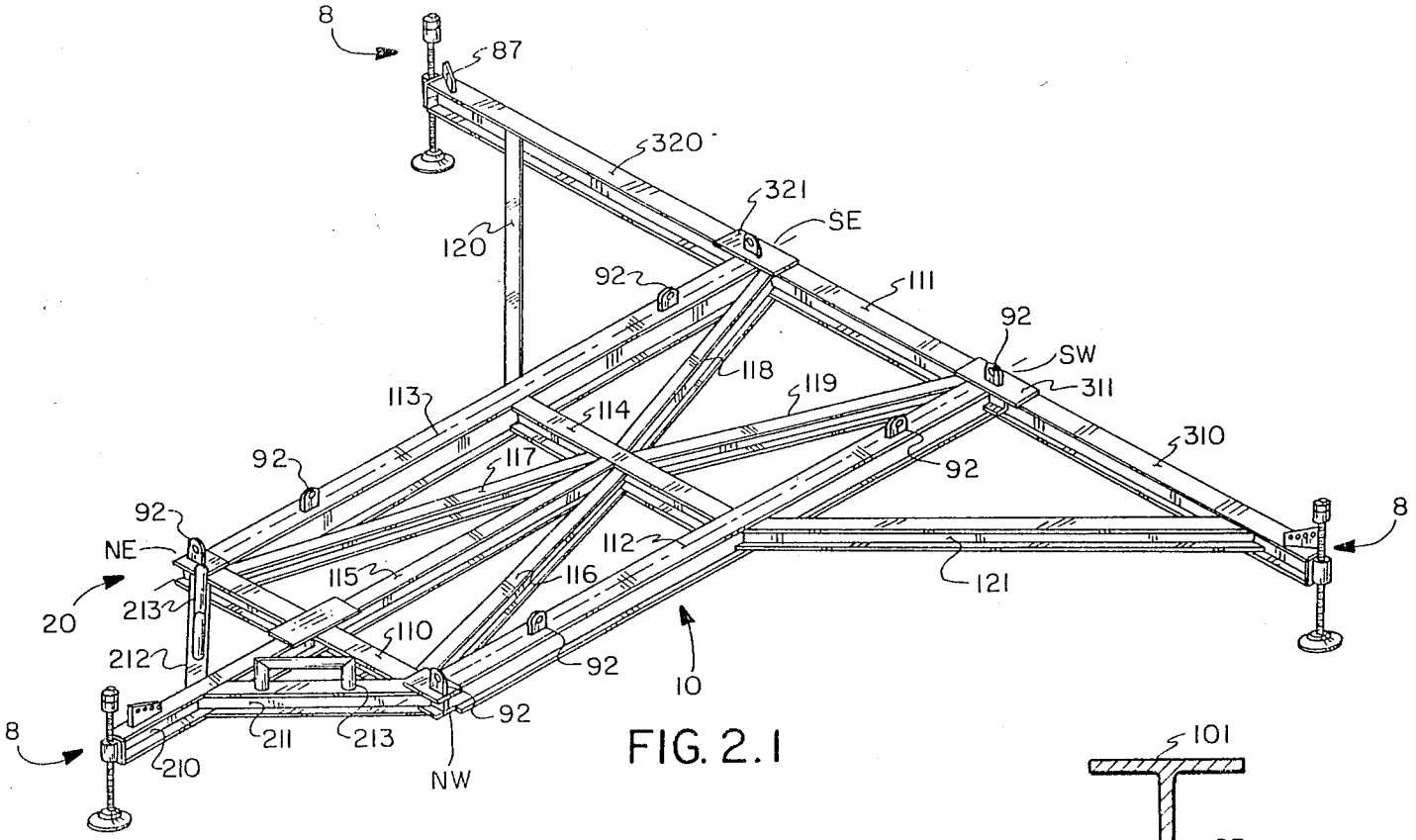
FIG. 2.1
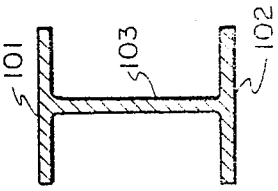
FIG. 2.2

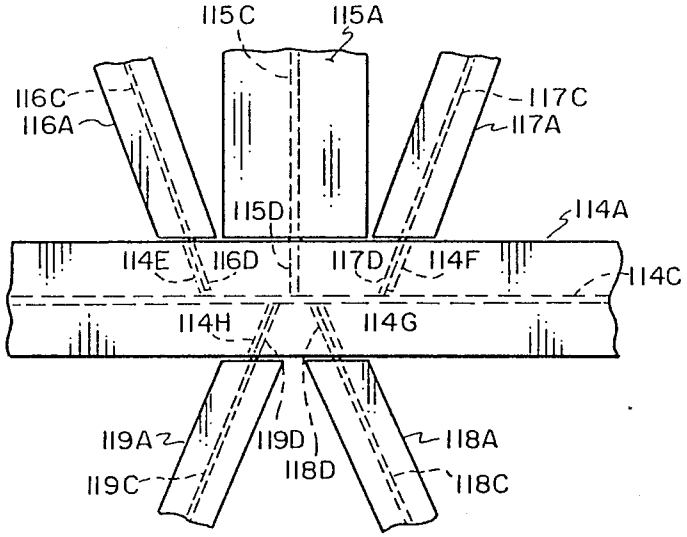
FIG. 3.1
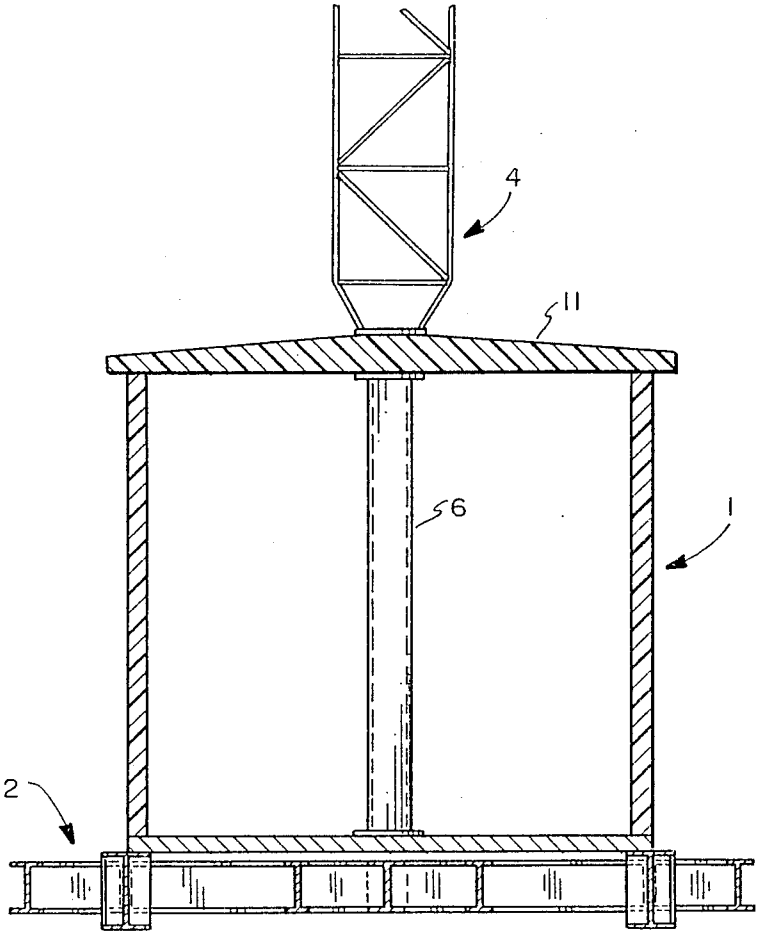
FIG. 2.3

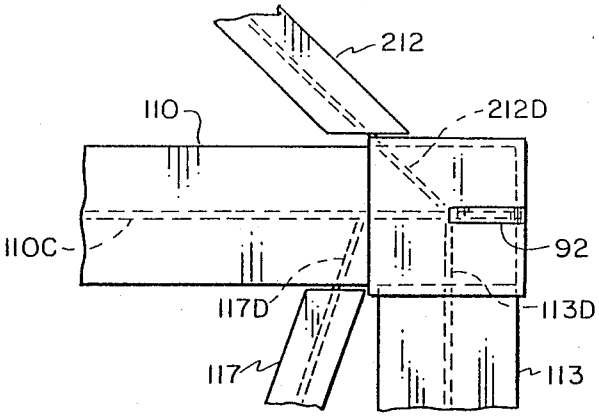
FIG. 5.1
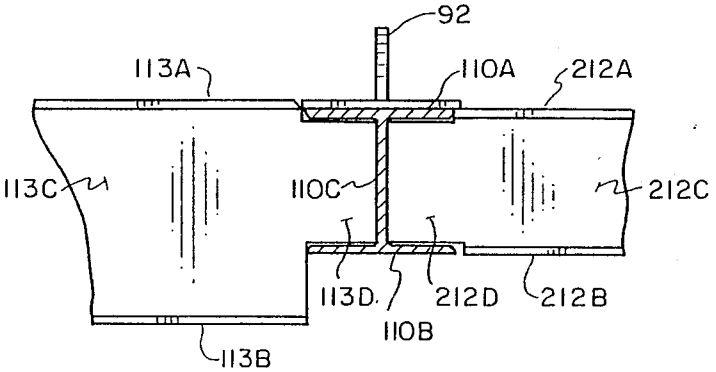
FIG. 5.2
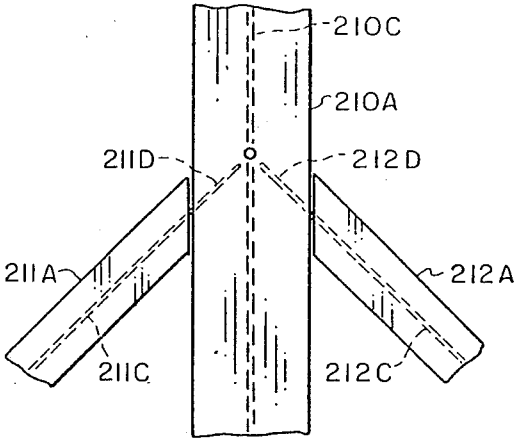
FIG. 4.1
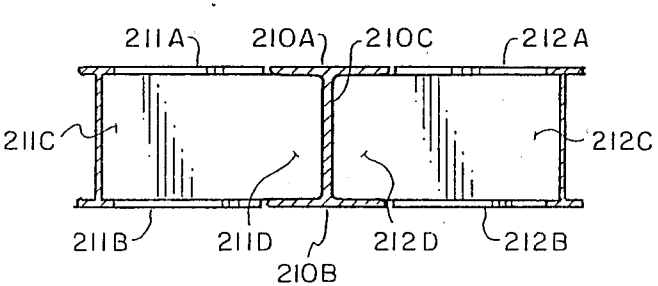
FIG. 4.2

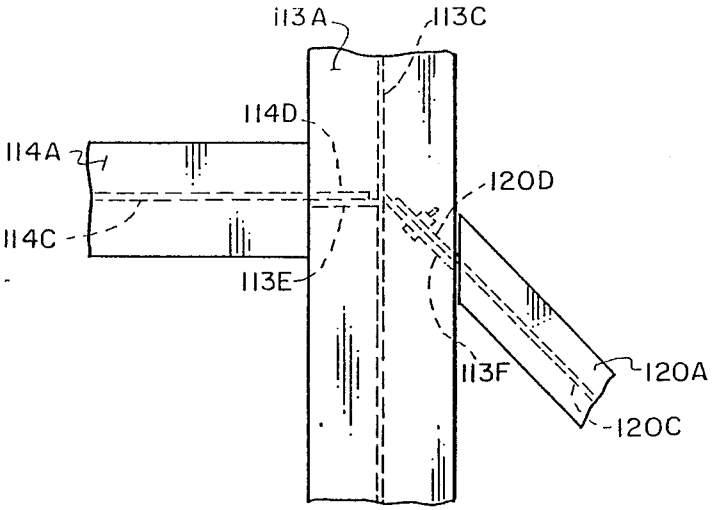
FIG. 7.1
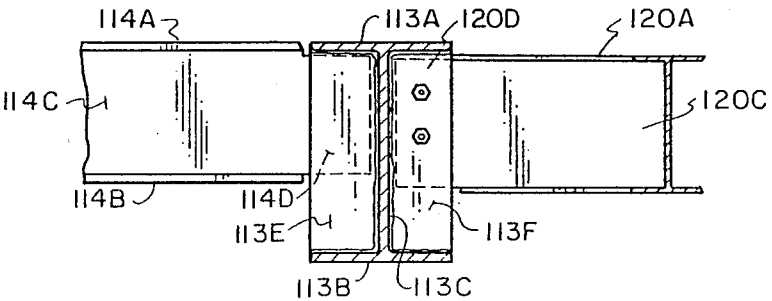
FIG. 7.2
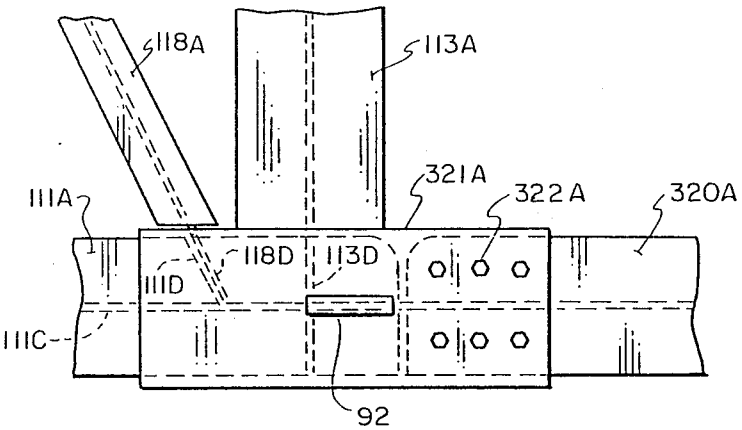
FIG. 6.1
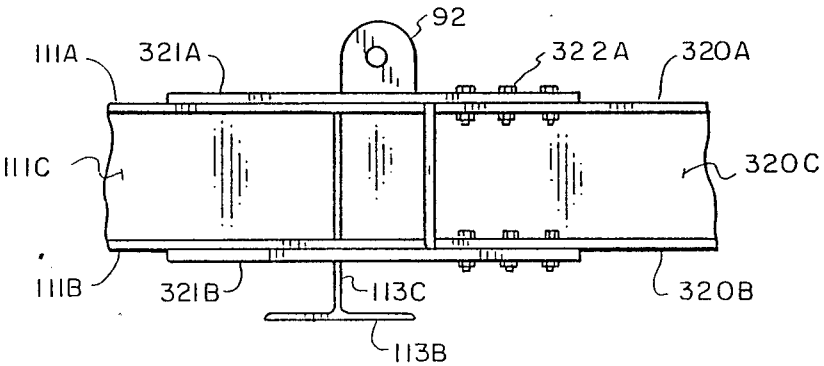
FIG. 6.2

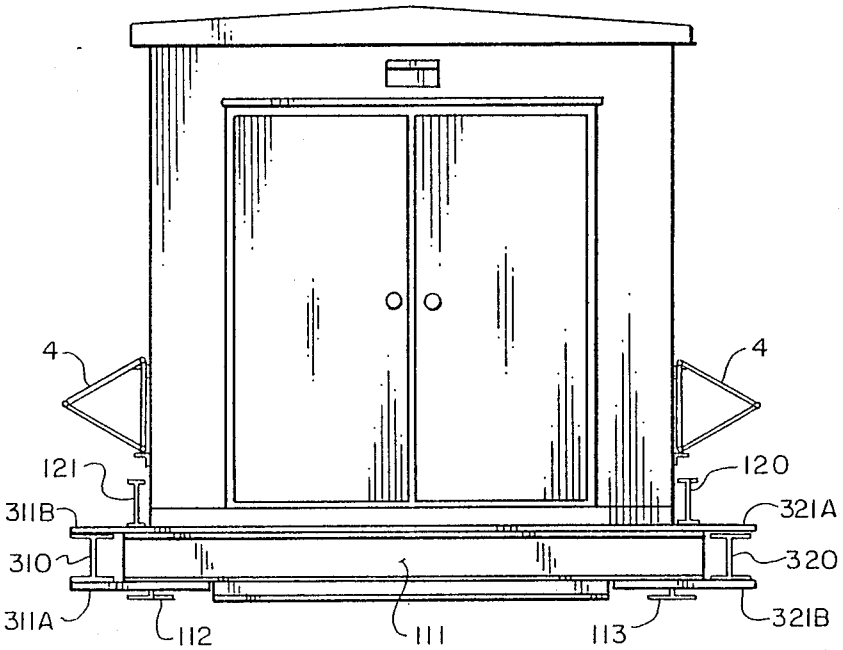
FIG. 11.2
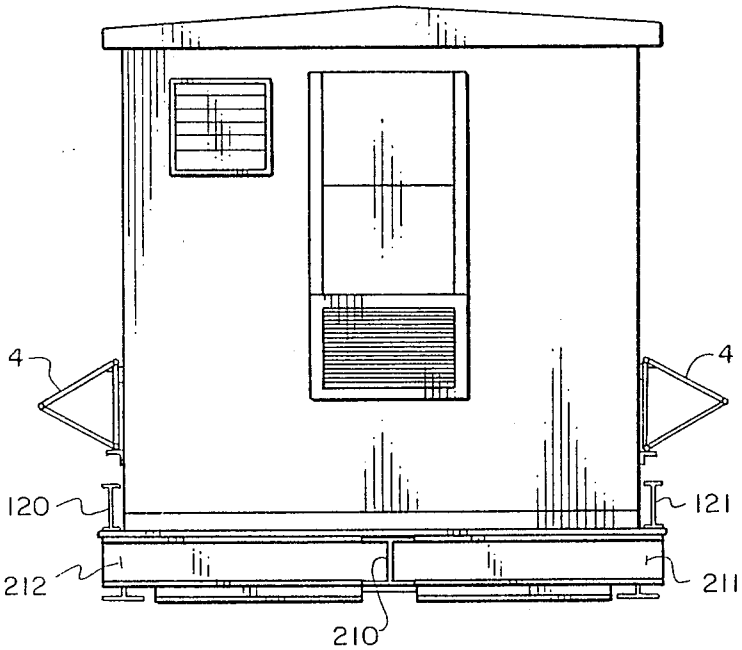
FIG. 11.1

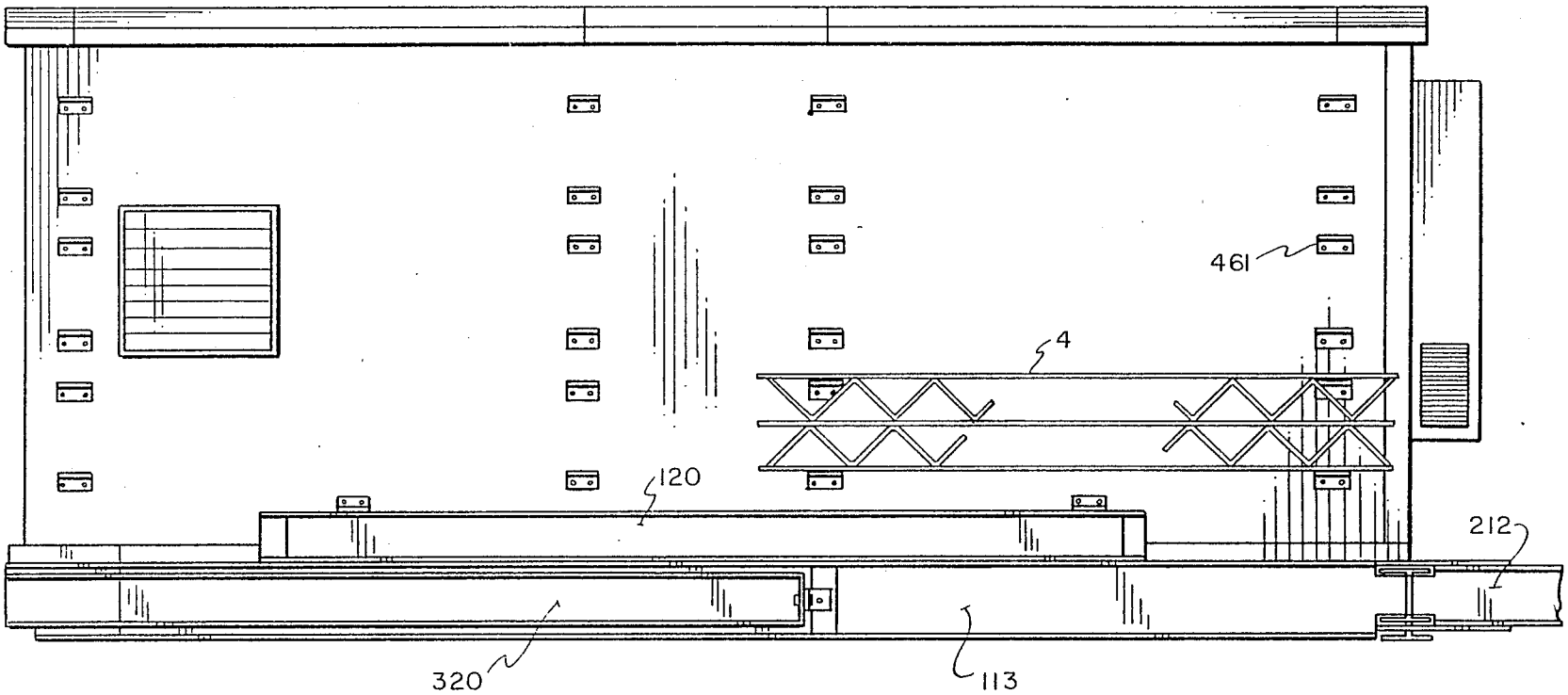
FIG. 11.4
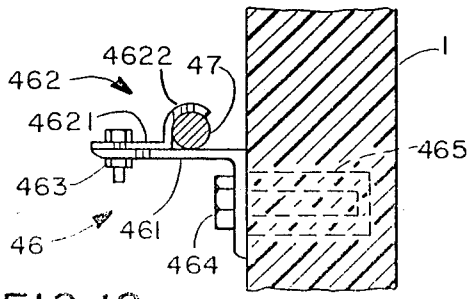
FIG. 12

TRANSPORTABLE CMR CELL SITE

CROSS REFERENCE TO RELATED APPLICATIONS

Cross reference is made to the following related patent applications, both filed on the same date, and by the same inventors as this application:

"CMR Cell Site," (Ser. No. 135,855) and "Foundation for a CMR Cell Site" (Ser. No. 07/135,867).

FIELD OF THE INVENTION

This invention relates to CMR (Cellular Mobile Radiotelephone) technology and, more particularly, to a CMR cell site configuration, including a foundation, self-contained equipment edifice, and antenna tower, all of which may be easily transportable and quickly erected.

BACKGROUND OF THE INVENTION

Cellular Mobile Radiotelephone (CMR) service is one of the fastest growing telecommunication services currently offered. For a very useful introductory dissertation relating to CMR technology, see Stephen W. Gibson, "Cellular Mobile Telephones," Prentice Hall, (1987). See also, Thomas C. Bartee (Ed.), "Digital Communications," Howard W. Sams and Company, pp. 247–279, (1986).

In order to meet the volatile demands of a rapidly growing market, the provider of CMR service is often called upon to install and put into service a CMR cell site within a very demanding time frame. The requirement for rapid deployment of a CMR cell site has engendered various approaches. One approach to rapid deployment involves loading the CMR equipment building, with an internal generator, on a flat-bed truck and transporting the equipment and generator to a cell site at which an antenna tower has been installed. This approach requires significant site preparation (antenna-tower installation) and is of limited utility, inasmuch as it fails to afford an easily transportable antenna tower.

Another approach would load the required generator on a flat-bed truck and transport the antenna tower on a trailer in tow. The approach proves to be more costly and cumbersome than desired. In addition, the above approach would require a generator pad and a foundation for the equipment building, as well as for the antenna tower.

Therefore, what is required is a cell-site configuration that is readily transportable. In addition, it is important that the cell site be quickly erected and put into service. To this end, the configuration should be modular and self-contained. In order to facilitate deployment of the cell site, an elaborate degree of site preparation should be avoided. In addition, the configuration should be able to serve as a permanent site if called upon to do so.

DISCLOSURE OF THE INVENTION

The above and other objects, advantages, and capabilities are achieved in one aspect of the invention by a CMR-equipment configuration that facilitates both transportation to a cell site and, at the site, rapid installation of the CMR equipment and accompanying antenna tower. The CMR equipment incorporates a foundation that includes (i) a rectangular center structure formed from a front horizontal section, a rear horizontal section, a left vertical section, and a right vertical section, and (ii) a nose structure attached to and extending vertically from the front horizontal section.

A self-contained CMR equipment edifice, having four walls, a floor and a roof, is secured to the rectangular center structure of the foundation by a plurality of flange means positioned at predetermined locations on the edifice and affixed to both the foundation and walls of the edifice.

Several antenna tower sections are attached to the edifice by a number of identical antenna mounting assemblies. Each of the antenna mounting assemblies comprises a bracket attached to a wall of the edifice and a pipe strap removably affixed to the bracket.

Left and right crossmember sections are attached to walls of the edifice by the above-mentioned flange means. The left and right crossmember sections are, in turn, respectively secured to top plates of the left vertical and right vertical sections, thereby securing the edifice to the foundation. Left and right leg sections, pivotably attached to opposite ends of the rear horizontal section, are folded into proximity with, respectively, the left vertical section and the right vertical section.

In a preferred embodiment, the rear horizontal section includes a left bracket plate pair, disposed at the left end of the rear horizontal section, for accommodating the pivotable attachment of the left leg section. A right bracket plate pair is similarly disposed at a right end for the right leg section.

BRIEF DESCRIPTION OF THE DRAWINGS

FIG. 2.1 is an isometric view of the foundation with the adjustable-height mounting assemblies attached. FIG. 2.2 illustrates the I-beam construction of the metal work used for the various sections of the foundation. FIG. 2.3 is a view depicting, inter alia, the interior of the edifice, and especially the manner in which the support column upholds the antenna tower.

FIG. 3.1 a top view of the interior of the center structure of the foundation. Specifically, FIG. 3.1 depicts the area of intersection of the interior vertical section 115, interior horizontal section 114, and the four interior cross sections, 116, 117, 118, and 119.

FIG. 4.1 is a top view and FIG. 4.2 is a cross sectional view of the intersection of the vertical nose member 210, the first crosspiece 211, and the second crosspiece 212.

FIG. 5 is a top view and FIG. 5.2 is a side view of corner NE, wherein front horizontal section 110, right vertical section 113, interior cross section 117, and second crosspiece 212 are joined.

FIG. 6.1 is a top view and FIG. 6.2 is a rear view of corner SE, wherein rear horizontal section 111, right vertical section 113, interior crosspiece 118, and leg section 320 are joined.

FIG. 7.1 is a top view and FIG. 7.2 is a cross sectional view illustrating the manner in which interior horizontal section 114 and right exterior crossmember 120 join with right vertical section 113.

FIG. 8 also depicts one of the three guy anchors, 87, affixed to the foundation, at the nose member, the left leg section, and the right leg section, for guying the antenna tower.

FIG. 12 depicts an antenna mounting assembly used to attach antenna sections to the edifice during transportation of the Transportable CMR Cell Site.

DESCRIPTION OF THE PREFERRED EMBODIMENT

For a better understanding of the subject Transportable CMR Cell Site, reference is made to the following Description and the appended Claims, in conjunction with the above-described Drawings.

Figure 1:
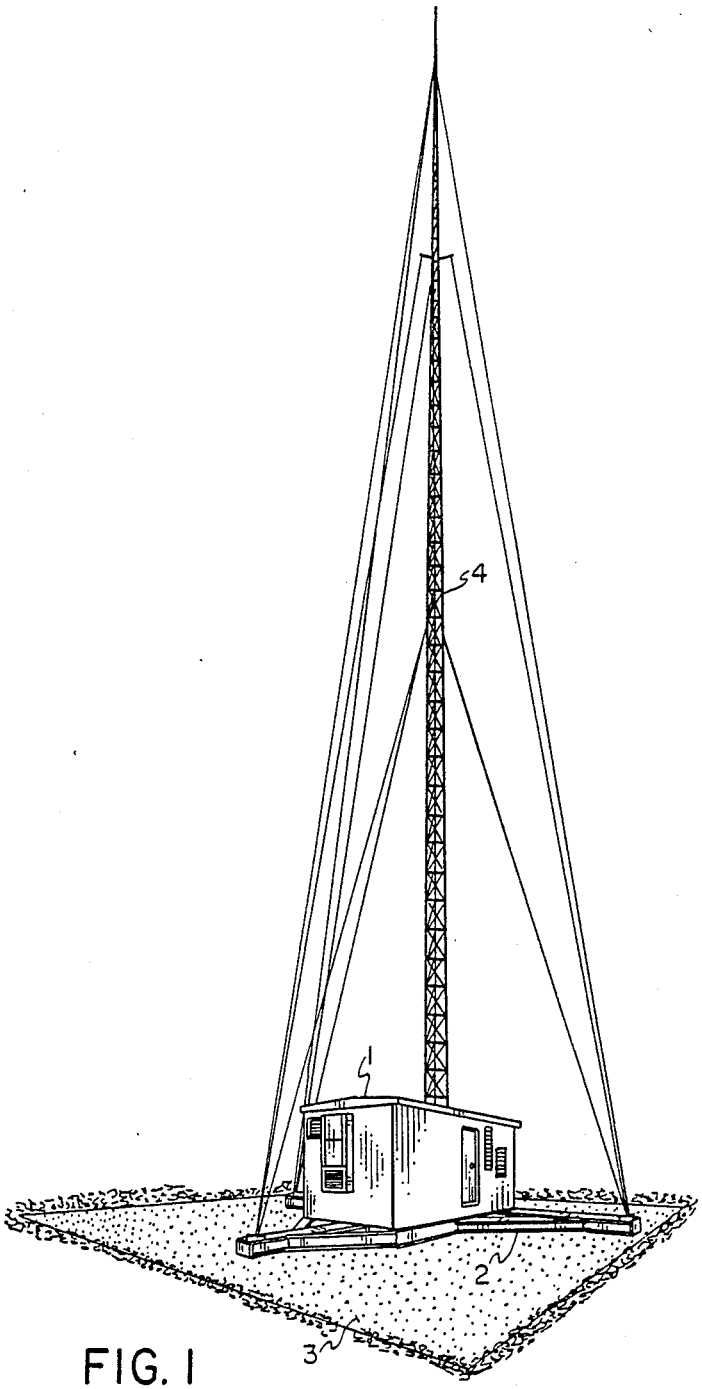
FIG. 1 a perspective view of the subject Transportable CMR Cell Site, showing the edifice 1, the foundation 2, and the antenna tower 4. (In this view, the subject Transportable CMR Cell Site is shown without the adjustable-height mounting assemblies, which are depicted in FIG. 8.)

Directing attention now to FIG. 1, depicted therein is an erected Transportable CMR Cell Site generally in accordance with the subject invention. Included are an edifice, or building, 1 that houses the electrical, communications and other equipment necessary to operate a CMR installation. Among the equipment typically included within the edifice are fixed network equipment required to provide eighteen, or more, voice channels, power equipment comprising an eight-day diesel fuel tank, 20-KVA generator, emergency backup power equipment, line-terminating equipment, 24,000-BTU airconditioning equipment with a high-temperature exhaust fan, and fire-suppression equipment. The building itself is fabricated from fiberglass and reinforced concrete and provides floor space according to its 22-by-9-foot (approximately) dimensions.

The building rests on a foundation, or skid, 2 that is placed on 40-by-40-foot leveled surface 3. The building, when mounted on the foundation, is approximately fourteen feet in height and weighs about 54,000 pounds.

A ninety-foot antenna tower 4 is mounted on the roof 11 of building 1. In practice, the antenna tower may be erected from nine ten-foot sections. The tower is guyed at the 35-, 65- and 85-foot levels by a plurality of guy wires attached between the antenna tower and the foundation.

A triangular antenna tower brace 5 (shown in FIG. 10) is embedded in roof 11 and secures the antenna tower to the building. A 10-inch-by-10-inch steel support column 6 within building 1 extends from the ceiling to the floor of the building, directly beneath the tower brace and the antenna tower. The support column is necessary to support the erected antenna tower on the roof of the building, and is designed to support the 21,000 pounds of downward force exerted by a tightly guyed tower. In order to isolate the support column and the interior of the building from lightening and other electrical effects, two 4-inch thicknesses of concrete are provided, one between the ceiling and the top of the column and one between the bottom of the column and the building floor. Steel support column 6 is depicted in FIG. 2.3.

Referring now to FIG. 2.1, an isometric view of the foundation that constitutes a part of the Transportable CMR Cell Site, the foundation is seen to include a generally rectangular center structure 10 having a perimeter defined by a pair of mutually parallel, horizontal side members in the form of a front horizontal section 110 and a rear horizontal section 111 and by a pair of mutually parallel, vertical side members in the form of a left vertical section 112 and a right vertical section 113. The horizontal sections are approximately twelve feet in length; the vertical sections are thirty-two feet in length. Sections 110, 111, 112, and 113 define four corners, one at each point of intersection between a vertical section and a horizontal section. Specifically, sections 110 and 112 form the NW corner, sections 110 and 113 form the NE corner, sections 113 and 111 form the SE corner, and sections 111 and 112 form the SW corner.

Each of sections 110 through 113, alluded to above, is implemented in the form of a steel I-beam having the cross section depicted in FIG. 2.2. That is, each of the sections comprises an integral steel beam exhibiting a horizontal top plate 101, a horizontal bottom plate 102, and a vertical center panel 103. (Although each of sections 110 through 113, as well as other sections or members introduced below, is characterized by an I-beam cross section, the specific height, and width dimensions of the respective cross sections need not be identical and, in fact, will vary in order to comport with the design objectives to be satisfied by the foundation.)

Center structure 10 also includes an interior horizontal section 114 attached to and extending between the left vertical section 112 and the right vertical section 113 at positions about the midpoints along the lengths of the left and the right vertical sections. An interior vertical section 115 is attached to and extends between the front horizontal section 110 and the interior horizontal section 114 at positions about the midpoints along the lengths of the front and the interior horizontal sections. Four interior cross sections, 116, 117, 118 and 119, respectively, are attached to and extend between the four corners (NW, NE, SE, and SW, respectively) and the midpoint of the interior horizontal section.

FIG. 3.1 (top view) illustrates the manner in which the interior vertical section 115 and the four interior cross sections, 116, 117, 118 and 119, intersect at the approximate midpoint of interior horizontal section 114.

The convention to be used in referencing these sections, as well as other sections or members subsequently referred to in this Description, will be the following. A top plate will be referred to as XXXA, a bottom plate as XXXB, and a vertical center panel as XXXC. With respect to sections that have a tongue portion extending integrally from a vertical center panel beyond the associated top and bottom plates, the tongue portion will be referred to as XXXD. Accordingly, interior vertical section 115, for example, comprises a top plate 115A, a bottom plate 115B, a vertical center panel 115C, and a tongue portion 115D extending integrally from vertical center panel 115C.

Tongue portion 115D of the interior vertical section 115 can be seen to be welded to vertical center panel 114C of the interior horizontal section. The four interior cross sections, 116, 117, 118, and 119, each similarly provide a tongue portion, 116D, 117D, 118D and 119D, respectively, that is welded to one of four oblique flanges 114E, 114F, 114G and 114H, emanating, at the indicated positions, from the vertical center panel 114C of the interior horizontal section 114.

The foundation also includes a nose structure 20 attached to and extending forwardly from the center structure at front horizontal section 110. The nose structure itself includes a vertical nose member in the form of section 210 that is joined to the front horizontal section and extends orthogonally therefrom. The nose member is approximately eight feet in length. A first crosspiece 211 is joined to corner NW, that is, to the junction of left vertical section 112 and front horizontal section 110, and to the vertical nose member 210 at a position located about the midpoint along the length of nose member 210. A second crosspiece 212 is similarly joined to corner NE, that is, to the junction of right vertical section 113 and front horizontal section 110, and to the vertical nose member 210 at a position located about the midpoint along the length of nose member 210. Crosspiece 211 and crosspiece 212 are, of course, joined to nose member 210 at opposite sides of vertical center panel 210C. Each of crosspieces 211 and 212 supports a mounting bracket 213 for a microwave antenna dish.

FIG. 4.1 (top view) and FIG. 4.2 (cross sectional view) depict in detail the intersection of vertical nose member 210, first crosspiece 211, and second crosspiece 212. Referring now to FIGS. 4.1 and 4.2, vertical nose member 210, first crosspiece 211, and second crosspiece 212, are each seen to comprise an integrally formed top plate, bottom plate, and vertical center panel.

FIGS. 4.1 and 4.2 clearly depict the manner in which tongue portions 211D and 212D of the crosspieces are obliquely joined, as by welding, to vertical center panel 210C of the vertical nose member.

FIG. 5.1 (top view) and FIG. 5.2 (side view) depict in detail corner NE, wherein front horizontal section 110, right vertical section 113, interior cross section 117, and crosspiece 212 are joined. Note that each of sections 113, 117 and 212 includes a tongue portion, respectively designated as 113D, 117D and 212D, representing and extension of the respective vertical center panels of those sections. The tongue portions are joined, as by welding, at positions shown in FIG. 5.1 to the vertical center panel llOC of the front horizontal section. The construction of corner NW, wherein front horizontal section 110, left vertical section 112, interior cross section 116 and crosspiece 211 are joined, is substantially identical to, but a mirror image of, corner NE.

Two leg members, in the form of a left leg section 310 and a right leg section 320, extend in respectively opposite directions from the corner SW formed by left vertical section 112 and rear horizontal section 111 and from the corner SE formed by rear horizontal section 111 and right vertical section 113. As seen from FIG. 2.1, the leg sections extend substantially collinearly with rear horizontal section 111 and, as more fully described below, are pivotably attached to the rear horizontal section.

FIG. 6.1 (top view) and FIG. 6.2 (rear view) depict in detail corner SE, wherein rear horizontal section 111, right vertical section 113, interior crosspiece 118, and right leg section 320 are joined. Note that interior crosspiece 118 includes a tongue portion 118D representing an extension of vertical center panel 118C. Tongue 118D is joined to rear horizontal section 111 by, for example, welding the tongue to an oblique flange 111D emanating from the vertical center panel 111C of the rear horizontal section. Right vertical section 113 has a tongue portion 113D that abuts orthogonally and is welded to vertical center panel 111C.

Included integrally with rear horizontal section 111 are two pairs of identical bracket plates 311 and 321, disposed at opposite ends of rear horizontal section at corners SW and SE, respectively. As shown in FIGS. 6.1 and 6.2, bracket plate pair 321 includes a top plate 321A contiguous to horizontal top plate 111A of the rear horizontal section 111 and includes a bottom plate 321B contiguous to horizontal bottom plate 111B of the rear horizontal section 111 at SE. Plates 321A and 321B extend a distance beyond the far edge of section 113 so as to accommodate the attachment of right leg section 320. Specifically, top bracket plate 321A exhibits six mounting holes in alignment with six corresponding mounting holes in the horizontal top plate 320A of the right leg section. Bottom bracket plate 321B similarly exhibits six mounting holes in alignment with six corresponding mounting holes in horizontal bottom plate 320B.

In an analogous fashion at corner SW, bracket plate pair 311 includes a top plate 311A contiguous to horizontal top plate 111A of the rear horizontal section 111 and includes a bottom plate 311B contiguous to horizontal bottom plate 111B of the rear horizontal section 111. Plates 311A and 311B extend a distance beyond the far edge of section 112 so as to accommodate the attachment of right leg section 310. Specifically, top bracket plate 311A exhibits six mounting holes in alignment with six corresponding mounting holes in the horizontal top plate 310A of the right leg section. Bottom bracket plate 311B similarly exhibits six mounting holes in alignment with six corresponding mounting holes in horizontal bottom plate 310B.

When the foundation is installed at a cell site, left leg section 310 and right leg section 320 are fully extended so as to be collinear with rear horizontal section 111 and so as to abut orthogonally to left vertical section 112 and right vertical section 113, respectively. In this configuration, a set of six mounting bolts are inserted through each of top plates 320A and 321A, and 310A and 311A, as well as through each of bottom plates 320B and 321B, and 310B and 311B. Associated nuts are then fastened onto the bolts in order to secure the leg sections to the bracket plates.

However, during transportation of the foundation, five of the six mounting bolts are removed from each of the four sets that are installed in the respective top and bottom plates. As shown in FIG. 6.1, only the innermost bolt, for example, 311A in FIG. 6.1, is allowed to remain in each of the four sets of bolts. The right leg section is then free to rotate, or pivot, about the vertical axis defined by bolt 322A and a corresponding innermost bolt 322B (not shown) that remains in bottom plates 320B and 321B. (A similar pair of bolts, 312A and 312B, are allowed to remain in the left leg section and bracket plates 311A and 311B.)

FIGS. 6.1 and 6.2 also depict the placement on corner SE of an eyelet 92 that is used to attach the foundation to a crane during installation of the cell site. Identical eyelets are placed on each of the other three corners. Two eyelets are placed on each of left vertical section 112 and on right vertical section 113.

The foundation also includes a left exterior crossmember 121 removably attached, in a manner described below, to left vertical section 112 and to left leg section 310. Similarly, a right exterior crossmember 120 is removably attached to right vertical section 113 and to right leg section 320. Right and left exterior crossmembers are removably attached to the remainder of the foundation so that, when it is necessary to transport or store the cell site, crossmembers 120 and 121 may be removed, and the left and right leg sections may be pivoted, or folded, into the left and right vertical sections, respectively.

FIG. 7.1 (top view) and FIG. 7.2 (cross sectional view) illustrate the manner in which interior horizontal section 114 and right exterior crossmember 120 join with right vertical section 113. As can be seen in FIGS. 7.1 and 7.2, right vertical section 113 provides an orthogonal panel 113E, extending orthogonally from vertical center panel 113C in the direction of interior horizontal section 114, and an oblique panel 113F, extending at an oblique angle from vertical center panel 113C in the direction of right exterior crossmember 120. Tongue portion 114D of interior horizontal section 114 is welded to orthogonal panel 113E. However, tongue portion 120D of the right exterior crossmember is removably attached to oblique panel 113F. In practice, tongue 120D may be bolted to panel 113F, as shown in FIGS. 7.1 and 7.2.

The manner in which left exterior crossmember 121 is joined to left vertical section 112 is not shown in a drawing, but is easily understood to be identical to, albeit a mirror image of, what is depicted in FIGS. 7.1 and 7.2 and described immediately above.

The subject Transportable CMR Cell Site also includes three identical, adjustable-height mounting assemblies 8. One each of the mounting assemblies is respectively attached to the nose structure, to the left leg section, and to the right leg section. As can be seen from FIG. 2.1, the mounting assemblies are attached to the nose structure and to the left and the right leg sections at positions substantially farthest from the center structure 10 of the cell site foundation.

Figure 8:
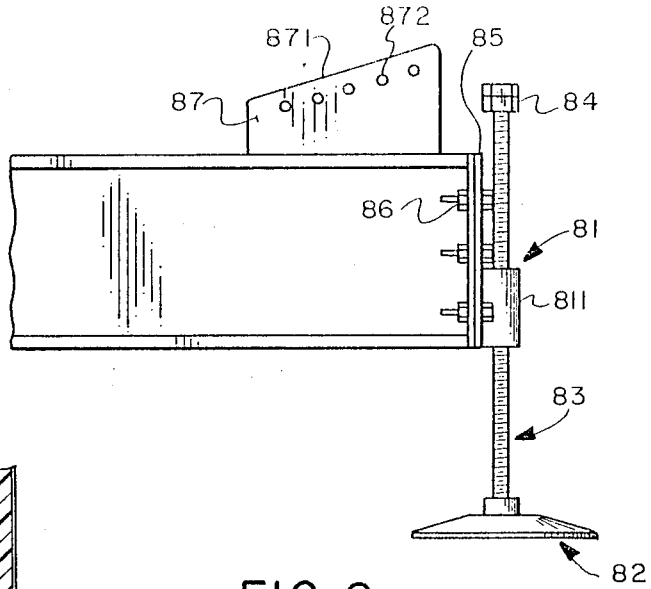
FIG. 8 is a detailed representation of an adjustable-height mounting assembly.

Referring now to FIG. 8, a detailed representation of an adjustable-height mounting assembly, the mounting assembly can be seen to include a substantially tubular coupling 81 affixed, for example, to the end of vertical nose member 210. Coupling 81 includes a pair of integral flanges 812 and 813 extending in opposite directions from the tubular center portion 811 of the coupling. The flanges are bolted via mounting bolts 86 to the end panel of vertical nose member 210, thereby affixing the coupling to the nose section. In an alternate embodiment, the coupling may be welded, rather than bolted, to the end of the respective leg section or nose member. A threaded rod 83 is threaded through coupling 81 and inserted at one end into a lock bracket 82. Finally, a threaded nut 84 is threaded onto rod 83 at an end of the rod opposite the end inserted into lock bracket 82.

The mounting assemblies, when adjusted in concert, act as stabilizers in high-wind conditions. The mounting assemblies are capable of withstanding 7500 pounds of downward force.

Figure 9:
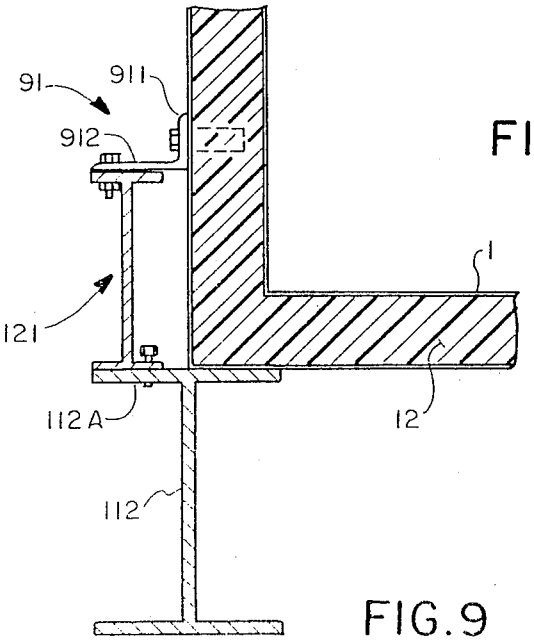
FIG. 9 depicts a cross sectional view of a corner of the edifice 1 and depicts in detail the manner in which the exterior crossmember is secured to the foundation 2.

FIG. 8 also depicts one of three guy anchors 87 that are respectively affixed to the vertical nose member 210 (as shown in FIG. 8), to the left leg section, and to the right leg section. Each of the guy anchors is generally planar in form and exhibits an uppermost edge 871 that is inclined in the direction toward the center of the foundation. A plurality of similarly inclined eyelets 872 are positioned along edge 871. The eyelets are used to secure guy wires between the foundation and the antenna tower at three elevations on the antenna tower. In a transportation mode of operation, the exterior crossmember itself is secured to the rectangular center structure 10 of the foundation 2 in the manner depicted in FIG. 9. The edifice can there be seen to rest on front and rear horizontal sections 110 and 111, respectively, and on left and right vertical sections 112 and 113, respectively. (Only left vertical section 112 is shown in FIG. 9.) The bottom 12 of the edifice rests on the top plate of the respective section, and the wall of the edifice is bolted to flange means 91 which is, in turn, secured, as by bolting, to the top plate of the exterior crossmember section. The bottom plate of the exterior crossmember section is, in turn, secured, as by bolting, to the respective top plate of one of sections 110, 111, 112 or 113.

Flange means 91 may assume numerous configurations. The flange depicted in FIG. 9 includes lateral section 912 bolted to the top plate of the exterior crossmember and an upright section 911 bolted to the the wall of the edifice. In practice, it has been found sufficient to provide two such flange means on each of left vertical section 112 and right vertical section 113.

In addition to flange means 91, the foundation has also been equipped with a plurality of eyelets 92 disposed, as shown in FIG. 2.1, about the perimeter of the center structure 10 of foundation 2. In practice, an eyelet has been placed on each of the corners, NW, NE, SE, and SW. Two eyelets are disposed along each of left vertical section 112 and right vertical section 113. The eyelets are used to attach the foundation to a crane, or other equivalent mechanism, on occasions when foundation must be transported or installed.

Figure 10:
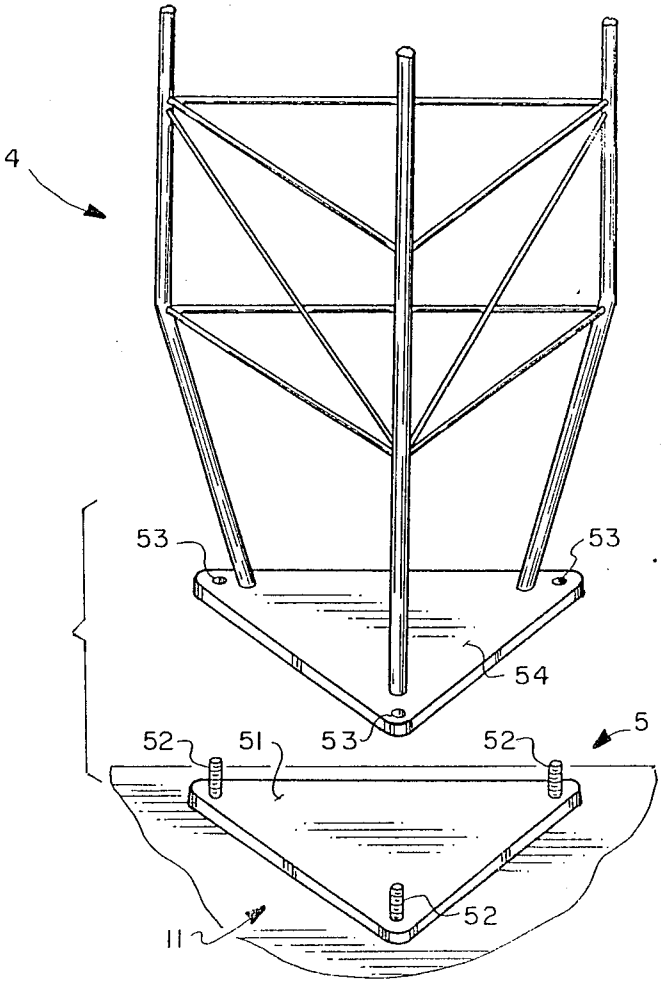
FIG. 10 depicts the antenna mounting brace which is embedded in roof 11 of the edifice.

FIG. 10 depicts the manner in which the antenna tower brace 5 is embedded in the roof 11 of edifice 1, and also the manner in which the antenna tower 4 is, in turn, secured to antenna tower brace 5. As can be seen in FIG. 10, the antenna tower brace exhibits a generally triangular base plate 51 having three mounting bolts 52 extending upwardly from base plate 51 at the vertices of the base plate. Three complementary apertures 53 in the antenna tower foundation plate 54 are then aligned over and dropped onto the corresponding mounting bolts. There is no requirement that the antenna foundation plate be secured to the base plate 51 with additional hardware. The mounting bolts adequately prevent lateral movement of the tower and the guy wires, when secured to the foundation, prevent motion of the tower in the horizontal direction. In fact, guying the antenna tower in this manner provides stability in the face of winds of 125 mph.

The antenna tower and tower brace are both commercially available from PiROD INC. of Plymouth, Ind. The antenna tower is identified as PiROD Model #18 ×90′ and is constructed of solid steel round member. The tower brace is PiROD Part No. 102974.

Figure 11:
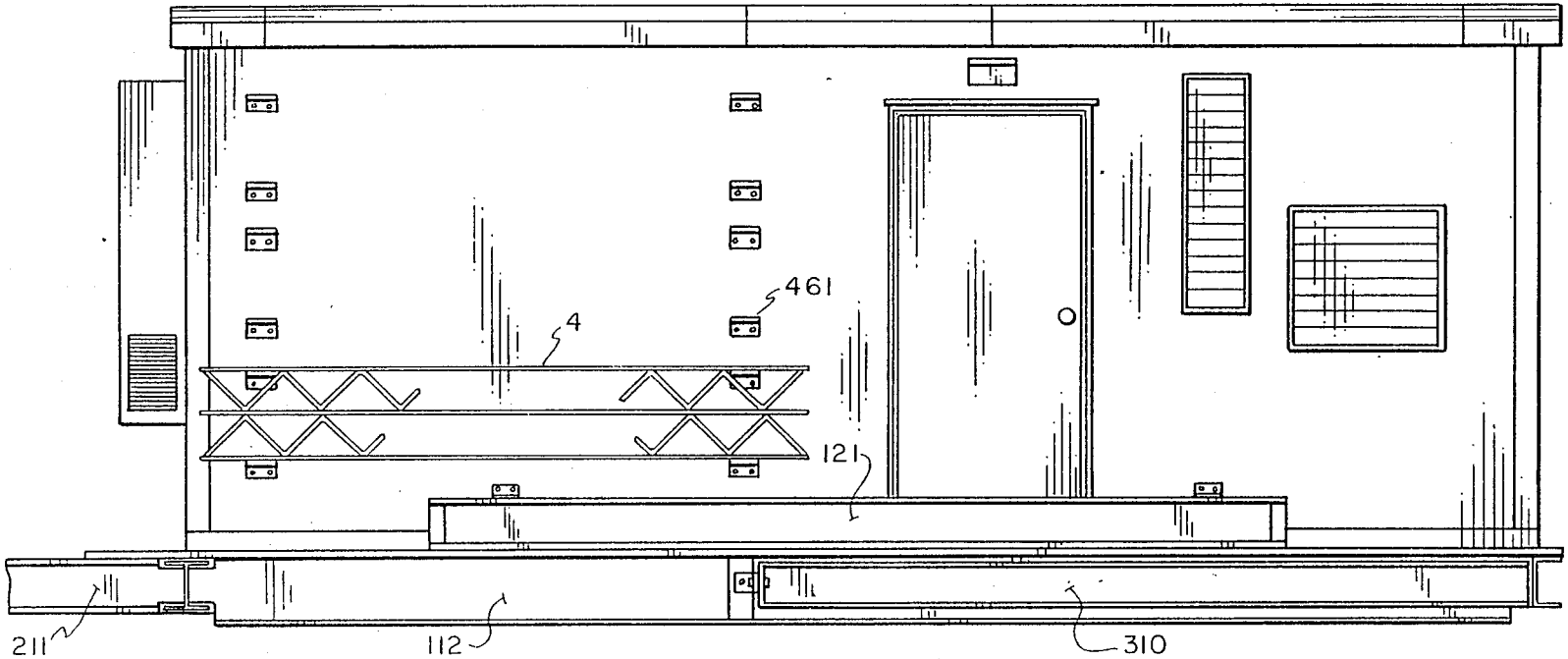
FIGS. 11.1 through 11.4 depict the Transportable CMR Cell Site as configured in anticipation of transportation. Specifically, FIG. 11.1 is a front elevation, FIG. 11.2 a rear elevation, FIG. 11.3 a left-side elevation, and FIG. 11.4 a right elevation.

FIGS. 11.1 (front elevation), 11.2 (rear elevation), 11.3 (left-side elevation), and 11.4 (right-side elevation) depict the subject Transportable CMR Cell Site in the configuration in which it is to be transported to a cell site.

In this configuration the antenna tower, which comprises, for example, nine ten-foot sections, has been disassembled and mounted horizontally on the front and the rear sides of the edifice. In practice, three sections are mounted on the left side, as shown in FIG. 11.3, and six on the right side, as shown in FIG. 11.4.

Each antenna section is secured to the edifice by virtue of a set of four antenna mounting assemblies 46. One of the antenna mounting assemblies is illustrated in FIG. 12. Each mounting assembly includes a bracket 461 bolted into a side of the edifice 1 by virtue of a mounting bolt 464 and a threaded insert 465 that is inserted, into the wall of the edifice. A pipe strap 462 has a flange portion 4621 removably affixed, as by bolting with a bolt 463, to bracket 461 and has an integral arcuate portion 4622 that is conformal to the cross section of an antenna tower pipe 47.

In addition, FIGS. 11.1 through 11.4 illustrate the disposition of the foundation's left leg section 310 and right leg section 320, as well as the disposition of the removable left exterior crossmember 121 and right exterior crossmember 120, in the transportable mode.

Removal of left exterior crossmember 121 from left vertical section 112 and from left leg section 310 and removal of five of the six mounting bolts in top plate 311A and five of the six mounting bolts in bottom plate 311B, allow left leg section 310 to be rotated, or pivoted, into left vertical section 112 as shown in FIGS. 11.2 and 11.3. The height and the width of left leg section 310 are such that section 310 folds neatly into section 112, with inside edges of top plate 310A and bottom plate 310B in proximity with the vertical center panel of left vertical section 112. Once removed from the remainder of the foundation, left exterior crossmember 121 is rested on top plate 112A and fastened to the left side of the building via a pair of mounting flanges as shown in FIG. 9.

In a manner entirely analogous to the above, right exterior crossmember 120 may be detached from the remainder of the foundation, and left leg section 320 folded into right vertical section 113. Right exterior crossmember 120 may then be attached to the right side of the edifice, atop the top plate 113A of right vertical section 113. See FIG. 11.4.

In this configuration, the left leg section is pivoted into proximity with the left vertical section so that the left leg section and the left vertical section are mutually in a substantially parallel orientation. Similarly, the right leg section is pivoted into proximity with the right vertical section so that the right leg section and the right vertical section are mutually in a substantially parallel orientation. See FIGS. 11.2, 11.3 and 11.4.

When disassembled and arranged as described immediately above, the Transportable CMR Cell Site is in condition to be transported for installation. Upon arrival at the intended location of installation, the Transportable CMR Cell Site is erected according to the following procedure. A tower crew uses a portable crane to lift the fiberglass and reinforced-concrete edifice, and the attached foundation, from the truck on which it is delivered. In this step, a hoisting crane is attached to the foundation at eyelets 92. The edifice is lifted from the truck and positioned for placement on support surface 3. After placement on the support surface, the left and the right leg sections, 310 and 320, are unfastened and swung away from left vertical section 112 and right vertical section 113, respectively. The crossmembers are removed from the sides of the edifice and are installed between the respective vertical section and leg section. The adjustable-height mounting assemblies are then attached to the left and right leg sections and to the nose structure.

The antenna tower sections are then unclamped from the sides of the edifice and are laid or out in sequence on the ground. The tower sections are assembled on the ground and guy wires are attached at the 35-, 65-, and 85-foot levels, with dual guying at the 65-foot level. The tower sections are then raised by the crane and placed in position to "stab" sections of the tower erected on the edifice. The tower sections are then bolted together using ⅜" stainless steel bolts. The completed tower is moved into position and dropped onto the antenna mounting plate cast into the roof of the edifice.

The guying process begins by threading 5/16-inch stainless steel guy were through the guy anchors attached to the legs and to the nose structure. In practice, guy wires are inserted through four eyelets in each of the guy anchors. Tension is then applied to the guy wires. After the guying process has been completed, a tower hand climbs the tower and releases the portable crane.

The Transportable CMR Cell Site described hereinabove offers a multitude of features and advantages unavailable in heretofore known approaches. The Cell Site may be erected on the 40-by-40-foot surface within as little as thirty-six hours from delivery to the site, and an acceptance test procedure completed within as little as two hours after connection to the mobile-cellular switch.

The cost of the Transportable CMR Cell Site is significantly lower than the cost of a typical, permanent, low-density cell site. The cost benefit derives primarily from the fact the Transportable CMR Cell Site requires no additional foundations, pads, towers or engineering or architectural services.

In addition, the layout of the equipment installed within the edifice can be standardized, according to the number of voice channels to be provided by the site. And the standardized design can be tailored to accommodate equipment acquired from various vendors.

The speed of deployment, attractive cost, and capability of design standardization promote the Transportable CMR Cell Site as the preferred approach to a number of cellular service opportunities.

For example, the Transportable CMR Cell Site equips a cellular service provider to rapidly enter an identified service area, with the attendant formidable competitive advantage typically garnered by the initial entrant.

The Transportable CMR Cell Site also provides the capability of enhancing existing markets that require additional capacity. CMR service can be made available to outlying or rural service areas that encompass large geographic areas. The Transportable CMR Cell Site can also can be used to expand existing markets by subdividing existing cells.

Moreover, the Transportable CMR Cell Site is extremely useful in emergency or disaster occasions when existing cells sites are temporarily put out of service.

Accordingly, although there has been shown and described what at present is believed to be a preferred embodiment of a Transportable CMR Cell Site, it will be obvious to those having skill in the art of CMR technology that various modifications may be made to the specific embodiments described herein without departure from the inventive concept defined by the appended claims.

With this in mind, it may be reiterated that the subject invention is deemed to reside in a Transportable Cell Site that includes a self-contained equipment edifice resting on an easily transportable foundation. The foundation described herein is rendered transportable largely by virtue of the removable crossmembers and the pivotably attached leg sections. Given the disclosure of this technique, a modicum of hindsight and the efforts of an ordinarily skilled routineer in the art will likely result in modifications that, although literally distinct from what is disclosed herein, will not measurably depart from the scope of the invention.

In addition, the roof-mounted antenna, guyed to the foundation, is deemed to be a salient advance over the known art. Because the antenna tower is secured by the weight of the edifice and is guyed to the foundation, the edifice acts as an "anchor" for the antenna tower. This mounting technique has permitted a guying radius much shorter than the guying radius that would be required were the antenna tower installed directly on a ground-level antenna pad. ("Guying radius" may be defined as the distance, measured from the base of the antenna tower, at which guy points must be positioned in order to assure stability of the antenna tower. In general, the guy radius is required to be approximately 60 percent of the effective antenna tower height. However, the roof-mounting technique permits a guying radius of approximately 20 percent of the combined height of the antenna and the edifice.) Variations in guying the antenna to the foundation will likely be derived, but not depart, from this inventive concept.

We claim:

1. A transportable CMR cell site that comprises:
- a foundation that includes a rectangular center structure having a rear section and a side section and includes a nose structure extending at and attached to a front of the rectangular center structure;
- a CMR equipment edifice having four walls, a floor and a roof and resting on the center structure of the foundation;
- a plurality of antenna tower sections attached to a wall of the CMR equipment edifice;
- a crossmember section attached to a wall of the edifice in proximity with a portion of the rectangular center structure of the foundation; and
- a leg section pivotably attached to said rear section of the rectangular center structure of the foundation and folded into proximity with said side section of the rectangular center structure of the foundation.

2. A transportable CMR cell site as defined in claim 1, wherein the rear section comprises an integral bracket plate pair disposed at an end of the rear section, said bracket plate pair for accommodating the attachment of the leg section.

3. A transportable CMR cell site as defined in claim 2, wherein the bracket plate pair comprises a top bracket plate and a bottom bracket plate and wherein the top bracket plate exhibits a plurality of mounting holes for alignment with a corresponding plurality of mounting holes exhibited by a top plate of the leg section and wherein the bottom bracket plate exhibits a plurality of mounting holes for alignment with a corresponding plurality of mounting holes exhibited by a bottom plate of the leg section.

4. A transportable CMR cell site as defined in claim 3, further comprising a pair of mounting bolts, one bolt inserted in and through innermost mounting holes of the top bracket plate and the top plate of the leg section, and one bolt inserted in and through innermost mounting holes of the bottom bracket plate and the bottom plate of the leg section.

5. A transportable CMR cell site as defined in claim 1, wherein the CMR equipment edifice is secured to the foundation by a plurality of flange means positioned at predetermined locations on the edifice and affixed both to the edifice and to the rectangular center structure of the foundation.

6. A transportable CMR cell site as defined in claim 5, wherein each of the flange means includes an upright section bolted to the edifice and a lateral section affixed to the rectangular center structure of the foundation through the crossmember section.

7. A transportable CMR cell site as defined in claim 1, wherein the antenna tower sections are attached to the CMR equipment edifice by a plurality of antenna mounting assemblies, each of said antenna mounting assemblies comprising a bracket (461) attached to the edifice and comprising a pipe strap (462) removably affixed to the bracket.

8. A transportable CMR cell site as defined in claim 7, wherein the pipe strap comprises a flange portion (4621) removably affixed to bracket and an integral arcuate portion (4622) conformal to a cross section of an antenna tower section.

9. An transportable CMR cell site as defined in claim 8, wherein each of brackets is attached to the edifice by virtue of a mounting bolt (464) and a threaded insert that is inserted into a wall of the CMR equipment edifice.

10. A transportable CMR cell site as defined in claim 9, wherein the pipe strap comprises a flange portion (4621) removably affixed to a bracket and an integral arcuate portion (4622) conformal to a cross section of an antenna tower section.

11. A transportable CMR cell site as defined in claim 1 further comprising a plurality of eyelets disposed on the rectangular center structure for coupling the foundation to a lifting mechanism.

12. A transportable CMR cell site as defined in claim 11, wherein eyelets are disposed on four corners of the rectangular center structure.

13. A transportable CMR cell site that comprises:
- a foundation that includes (i) a rectangular center structure formed from a front section, a rear section, a left section, and a right section and a nose structure attached to and extending from the front section;
- a CMR equipment edifice having a plurality of walls, a floor, and a roof, said CMR equipment edifice secured to the rectangular center structure of the foundation by a plurality of flange means positioned at predetermined locations on the foundation and affixed to both the foundation and walls of the edifice;
- a plurality of antenna tower sections attached to one wall of the edifice by a plurality of antenna mounting assemblies, each of said antenna mounting assemblies comprising a bracket (461) attached to said one wall of the edifice and comprising a pipe strap (462) removably affixed to the bracket;
- a crossmember section attached to one wall of the edifice and affixed to one of said left and right sections; and
- a pivotably leg section attached to the rear section and folded into proximity with one of said left and right sections.

14. A transportable CMR cell site as defined in claim 13, wherein the front section, the rear section, the left section, the right section, the crossmember section, and the pivotable leg section each is constructed in the form of an I-beam and comprises an integrally formed top horizontal plate, bottom horizontal plate, and vertical center panel that is disposed between the top and the bottom horizontal plates.

15. A transportable CMR cell site as defined in claim 14, wherein the rear section comprises an integral bracket plate pair disposed at an end of the rear section, said bracket plate pair for accommodating the attachment of the leg section.

16. A transportable CMR cell site as defined in claim 15, wherein the bracket plate pair comprises a top bracket plate and a bottom bracket plate and wherein the top bracket plate exhibits a plurality of mounting holes for alignment with a corresponding plurality of mounting holes exhibited by a top plate of the leg section and wherein the bottom bracket plate exhibits a plurality of mounting holes for alignment with a corresponding plurality of mounting holes exhibited by a bottom plate of the leg section.

17. A transportable CMR cell site as defined in claim 16, further comprising a pair of mounting bolts, one bolt inserted in and through innermost mounting holes of the top bracket plate and the top plate of the leg section, and one bolt inserted in and through innermost mounting holes of the the bottom bracket plate and the bottom plate of the leg section.

18. A transportable CMR cell site as defined in claim 17, wherein each of the flange means includes an upright section bolted to a wall of the edifice and affixed to one of said left and right sections of the foundation.

19. A transportable CMR cell site as defined in claim 18, wherein the pipe strap comprises a flange portion removably affixed to a bracket and an integral arcuate portion conformal to a cross section of an antenna tower section.

20. An transportable CMR cell site as defined in claim 19, wherein each of the brackets is attached to the edifice by virtue of a mounting bolt (464) and a threaded insert that is inserted into a wall of the CMR equipment edifice.

21. A transportable CMR cell site comprising:

(a) a foundation for supporting an edifice on a surface and for guying an antenna tower, the foundation consisting essentially of a number of linear sections, each of which is characterized by a generally I-shaped cross section and comprising:
- a front section;
- a rear section;
- a left section; and
- a right section, said front, rear, left and right sections arranged to form a generally rectangular perimeter;
- a left leg section pivotably attached to the rear section at a left end of the rear section;
- a right leg section pivotably attached to the rear section at a right end of the rear section;
- a left exterior crossmember section for removable attachment to the left leg section and to the left section about a midpoint along the length of the left section, said left exterior crossmember section attached to a front wall of the edifice and to the left section;
- a right exterior crossmember section for removable attachment to the right leg section and to the right section about a midpoint along the length of the right section, said right exterior crossmember section attached to a rear wall of the edifice and to the right section; and
- a nose structure attached to and extending from the front section;

(b) a CMR equipment edifice having four walls, a floor and a roof and resting on the front section, the rear section, left section, and right section of the foundation; and (c) a plurality of antenna tower sections attached to at least one wall of the CMR equipment edifice.

22. A transportable CMR cell site as defined in claim 21, wherein the rear section comprises (i) a left bracket plate pair disposed at the left end of the rear section, said left bracket plate pair for accommodating the attachment of the left leg section and (ii) a right bracket plate pair disposed at the right end of the rear section, said right bracket plate pair for accommodating the attachment of the right leg section.

23. A transportable CMR cell site as defined in claim 22, wherein each of the bracket plate pairs comprises a top bracket plate and a bottom bracket plate and wherein the top bracket plate exhibits a plurality of mounting holes for alignment with a corresponding plurality of mounting holes exhibited by a top plate of a leg section and wherein the bottom bracket plate exhibits a plurality of mounting holes for alignment with a corresponding plurality of mounting holes exhibited by a bottom plate of a leg section.

24. A transportable CMR cell site as defined in claim 23, wherein (i) the let leg section is pivotably attached to the left bracket plate pair by virtue of a mounting bolt inserted in and through innermost mounting holes of the top bracket plate of the left bracket plate pair and of the top plate of the left leg section and by virtue of a mounting bolt inserted in and through innermost mounting holes of the bottom bracket plate of the left bracket plate pair and of the bottom plate of the left leg section and (ii) the right leg section is pivotably attached to the right bracket plate pair by virtue of a mounting bolt inserted in and through innermost mounting holes of the top bracket plate of the right bracket plate pair and of the top plate the right leg section and by virtue of a mounting bolt inserted in and through innermost mounting holes of the bottom bracket plate of the right bracket plate pair and of the bottom plate of the right leg section.

25. A transportable cell site as defined in claim 24, wherein the left leg section is pivoted into proximity with the left section so that the left leg section and the left section are mutually in a substantially parallel orientation and wherein the right leg section is pivoted into proximity with the right section so that the right leg section and the right section are mutually in a substantially parallel orientation.

26. A transportable CMR cell site as defined in claim 25, wherein the CMR equipment edifice is secured to the foundation by a plurality of flange means positioned at predetermined locations on the edifice and affixed both to the edifice and to the rectangular center structure of the foundation.

27. A transportable CMR cell site as defined in claim 26, wherein each of the flange means includes an upright section bolted to a wall of the edifice and affixed to one of said left and right sections.

28. A transportable CMR cell site as defined in claim 27, wherein the antenna tower sections are attached to the CMR equipment edifice by a plurality of antenna mounting assemblies, each of said antenna mounting assemblies comprising a bracket (461) attached to the edifice and comprising a pipe strap (462) removably affixed to the bracket.

29. A transportable CMR cell site as defined in claim 28, wherein the pipe strap comprises a flange portion (4621) removably affixed to bracket and an integral arcuate portion (4622) conformal to a cross section of an antenna tower section.

30. An transportable CMR cell site as defined in claim 29, wherein each of brackets is attached to the edifice by virtue of a mounting bolt (464) and a threaded insert that is inserted into a wall of the CRM equipment edifice.

31. A transportable CMR cell site as defined in claim 30, wherein the pipe strap comprises a flange portion (4621) removably affixed to a bracket and an integral arcuate portion (4622) conformal to a cross section of an antenna tower section.

32. A transportable CMR cell site as defined in claim 1 further comprising a plurality of eyelets disposed on the rectangular center structure for coupling the foundation to a lifting mechanism.

33. A transportable CMR cell site as defined in claim 32, wherein eyelets are disposed on four corners of the rectangular center structure.

* * * * *